US005997370A

United States Patent [19]

Fetchko et al.

[11] Patent Number: 5,997,370

[45] Date of Patent: Dec. 7, 1999

[54] OUTBOARD HYDRAULIC STEERING ASSEMBLY WITH REDUCED SUPPORT BRACKET ROTATION

[75] Inventors: Eric Fetchko; Andrew McFadyen, both of Richmond, Canada

[73] Assignee: Teleflex (Canada) Limited, Richmond, Canada

[21] Appl. No.: 09/012,793

[22] Filed: Jan. 23, 1998

[51] Int. Cl.[6] ..... B63H 5/125

[52] U.S. Cl. ..... 440/61; 440/63; 114/150

[58] Field of Search ..... 440/59, 61, 63; 114/144 R, 150

[56] References Cited

U.S. PATENT DOCUMENTS

| | | | |
|---|---|---|---|
| 4,373,920 | 2/1983 | Hall et al. | 440/59 |
| 5,092,801 | 3/1992 | McBeth | 440/61 |

*Primary Examiner*—Jesus D. Sotelo
*Attorney, Agent, or Firm*—Norman M. Cameron

[57] ABSTRACT

A hydraulic steering assembly applies a force to a tiller arm of a marine, outboard propulsion unit and rotates the propulsion unit about a steering axis between a center position and hard over positions to each side of the center position. The propulsion unit is supported for arcuate movement about a tilt axis which is generally perpendicular to the steering axis. The steering assembly includes a hydraulic steering cylinder with an elongated piston rod reciprocatingly mounted within the cylinder for movement along a piston rod axis. A pair of support arms are pivotable about the tilt axis and are connected to the piston rod, allowing arcuate movement of the rod about the tilt axis, while maintaining the rod axis parallel to the tilt axis. A member is pivotally mounted on the tiller arm for pivoting about a first axis which is parallel to the steering axis. The cylinder arm is connected to the cylinder and extends radially outwards from the piston rod axis. The cylinder arm is pivotally connected to the member for pivoting about the second link axis which is parallel to the piston rod axis. The cylinder arm moves through a partially rotated position when the propulsion unit rotates from the center position to either hard over position. The second link axis and the rod axes are on a plane parallel to the steering axis at the partially rotated position.

9 Claims, 8 Drawing Sheets

OUTBOARD HYDRAULIC STEERING ASSEMBLY WITH REDUCED SUPPORT BRACKET ROTATION

This invention relates to hydraulic steering assemblies for outboard marine motors and, in particular, to steering systems where the support bracket rotation is minimized.

BACKGROUND OF THE INVENTION

Hydraulic steering systems for marine craft having outboard motors are well known and desirable accessories. Conventionally such steering systems have a steering wheel located remotely from the motor and associated steering components. A hydraulic pump is located on the steering wheel and is hydraulically connected to a steering assembly by hydraulic lines. The steering assembly is mounted on the outboard propulsion unit, or units in the case of marine craft having a plurality of outboard propulsion units, and includes a hydraulic cylinder with a piston rod which reciprocates and thus steers the propulsion unit about a steering axis.

U.S. Pat. No. 4,373,920 to Hall et al., teaches that the traveling cylinder can be attached to the tiller arm by a slider mechanism wherein a lost motion connection is established between the tiller arm and the cylinder in order to compensate for the arcuate movement of the tiller arm. Alternatively, a drag link mechanism can be pivotally attached between one end of the cylinder and the tiller arm. These mechanisms have certain limitations discussed in U.S. Pat. No. 5,092,801 to McBeth.

McBeth discloses a connector which provides a strong and simple universal connection between the hydraulic steering assembly and the tiller arm of the engine. This eliminates a lost motion type slider. However, the mechanism requires significant rotation of the support brackets about the tilt axis of the motor. This rotation may be inhibited by such factors as poor maintenance, including the overtightening of nuts and other components or by corrosion, for example. If the support brackets are thus inhibited from rotating, then the steering action is impaired. This possibility has prevented widespread commercial acceptance of the McBeth steering assembly, even though it appears to provide significant advantages over the prior art.

It is therefore an object of the invention to provide an improved hydraulic steering assembly for outboard motors which overcomes disadvantages associated with the prior art.

It is also an object of the invention to provide an improved hydraulic steering assembly for outboard motors which reduces significantly rotation of the support brackets about the tilt axis of the motor, thus allowing continued steering even when rotation of the brackets is impaired.

It is a still further object of the invention to provide an improved hydraulic steering assembly for outboard motors which is simple and reliable in construction and is relatively easy to install and maintain.

SUMMARY OF THE INVENTION

There is provided, according to the invention, a hydraulic steering assembly for applying a force to a tiller arm of a marine, outboard propulsion unit and, accordingly, rotating the propulsion unit about a steering axis between a center position and hard over positions to each side of the center position. The propulsion unit is supported for arcuate movement about a tilt axis which is generally perpendicular to the steering axis. The steering assembly includes a hydraulic steering cylinder with an elongated piston rod reciprocatingly mounted within the cylinder for movement along a piston rod axis. A pair of support arms are pivotable about the tilt axis and are connected to the piston rod, allowing arcuate movement of the rod about the tilt axis, while maintaining the rod axis parallel to the tilt axis. A member is pivotally mounted on the tiller arm for pivoting about a first axis which is parallel to the steering axis. The cylinder arm is connected to the cylinder and extends radially outwards from the piston rod axis. The cylinder arm is pivotally connected to the member for pivoting about the second link axis which is parallel to the piston rod axis. The cylinder arm moves through a partially rotated position when the propulsion unit rotates from the center position to either hard over position. The second link axis and the rod axis are on a plane parallel to the steering axis at the partially rotated position.

Preferably the cylinder arm is rotated away from the partially rotated position at the center position of the propulsion unit and at both hard over positions.

DETAILED DESCRIPTION OF THE PREFERRED EMBODIMENTS

Figure 1:
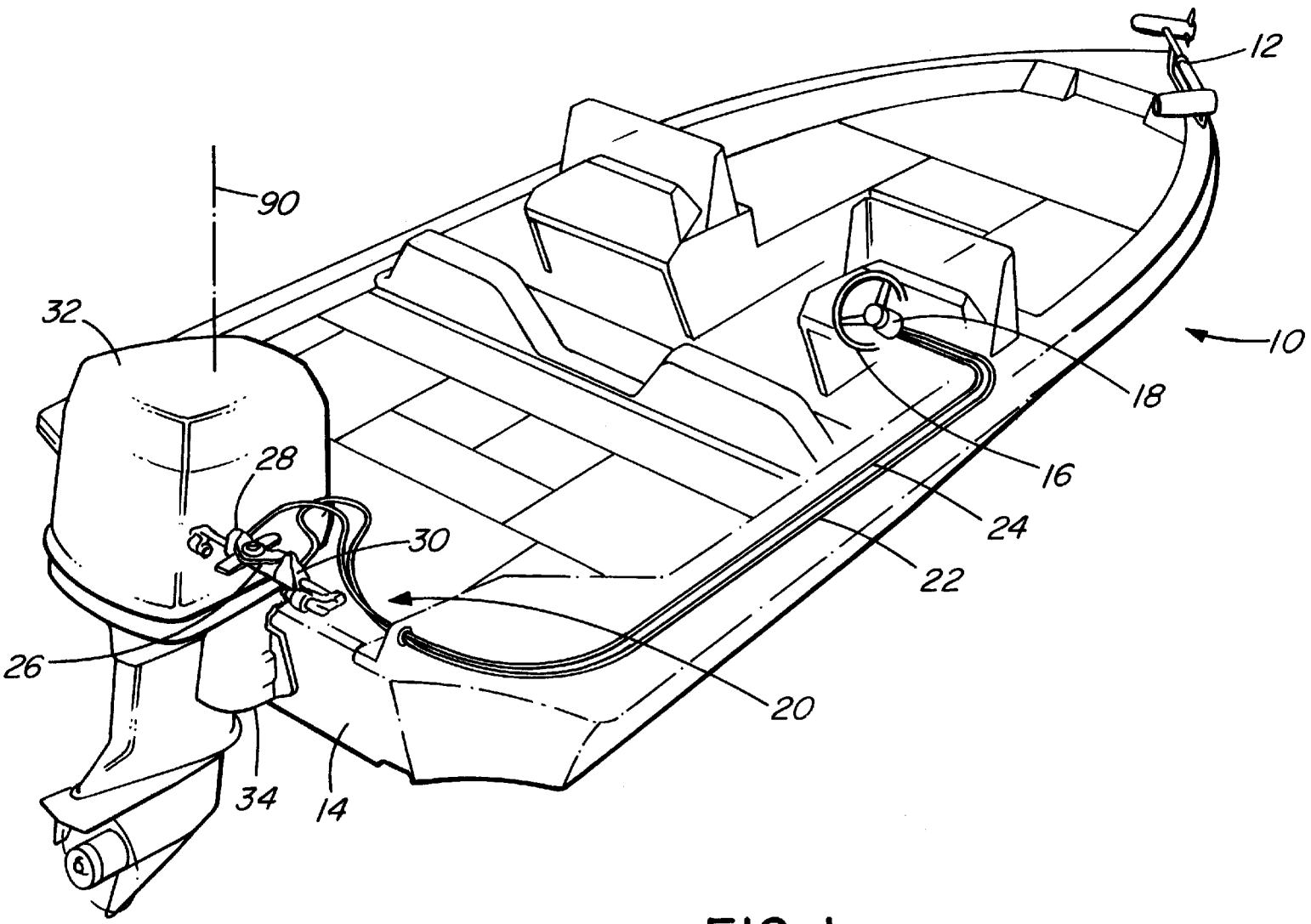
FIG. 1 is a top, rear isometric view of a boat fitted with an outboard motor and a hydraulic steering system according to an embodiment of the invention.

Referring to the drawings, and first to FIG. 1, this shows a boat 10 which is generally conventional and, accordingly, is only described briefly. The boat has a bow 12 and a stern 14. There is a steering wheel 16 fitted to a hydraulic pump 18. The pump 18 is hydraulically connected to a hydraulic steering system 20 by two hydraulic lines 22 and 24. The steering system includes a steering cylinder 26 with opposite ends 28 and 30. Hydraulic line 24 is connected to the end 30, while hydraulic line 22 is connected to end 28. The steering system is mounted on a conventional outboard motor 32 having a mid section 34 shown in better detail in the fragmentary view of FIG. 2.

Figure 4A:
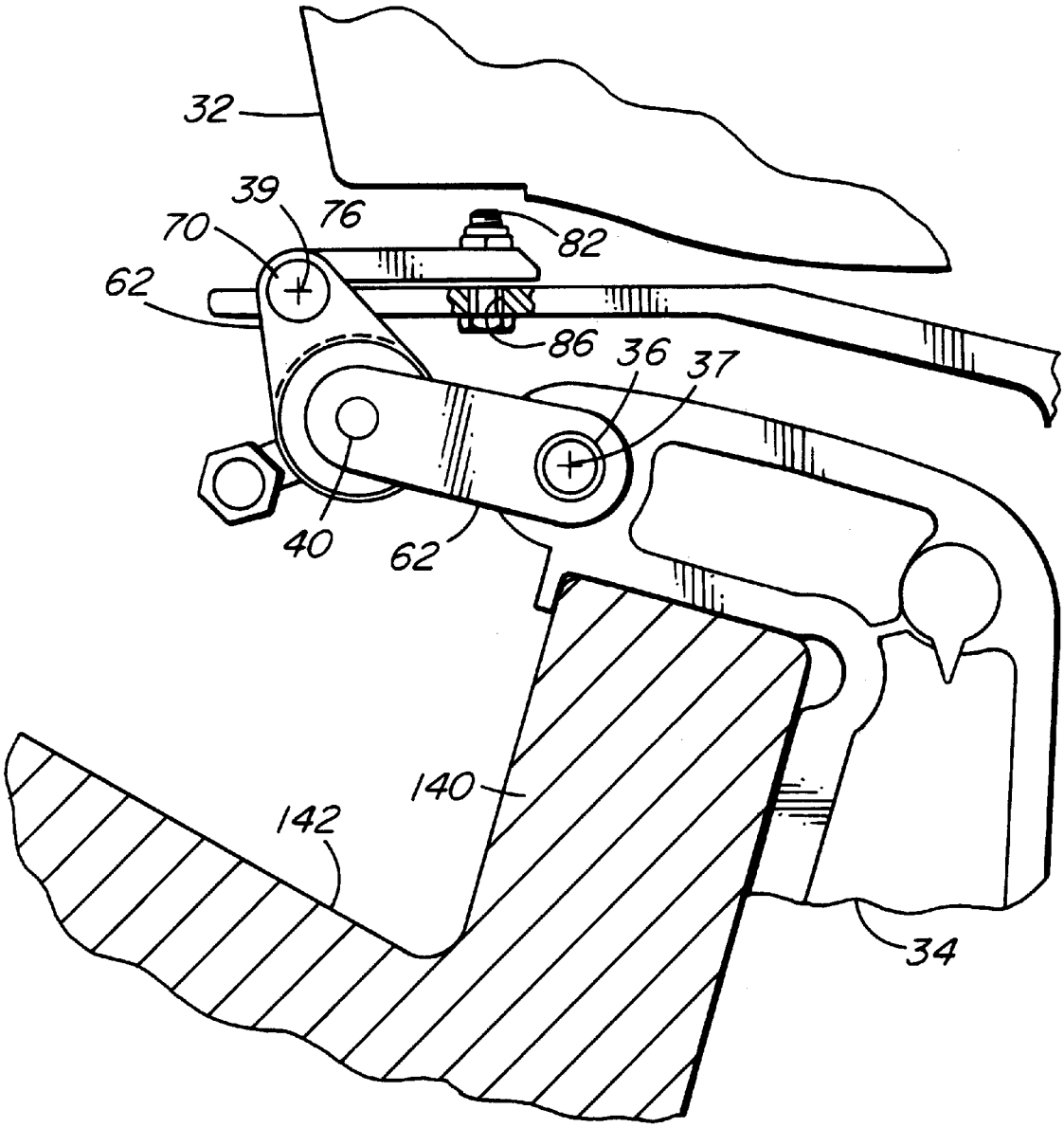
FIG. 4*a* is a side view thereof with a fragment of the transom and a fragment of the motor shown in the running position.
Figure 4B:
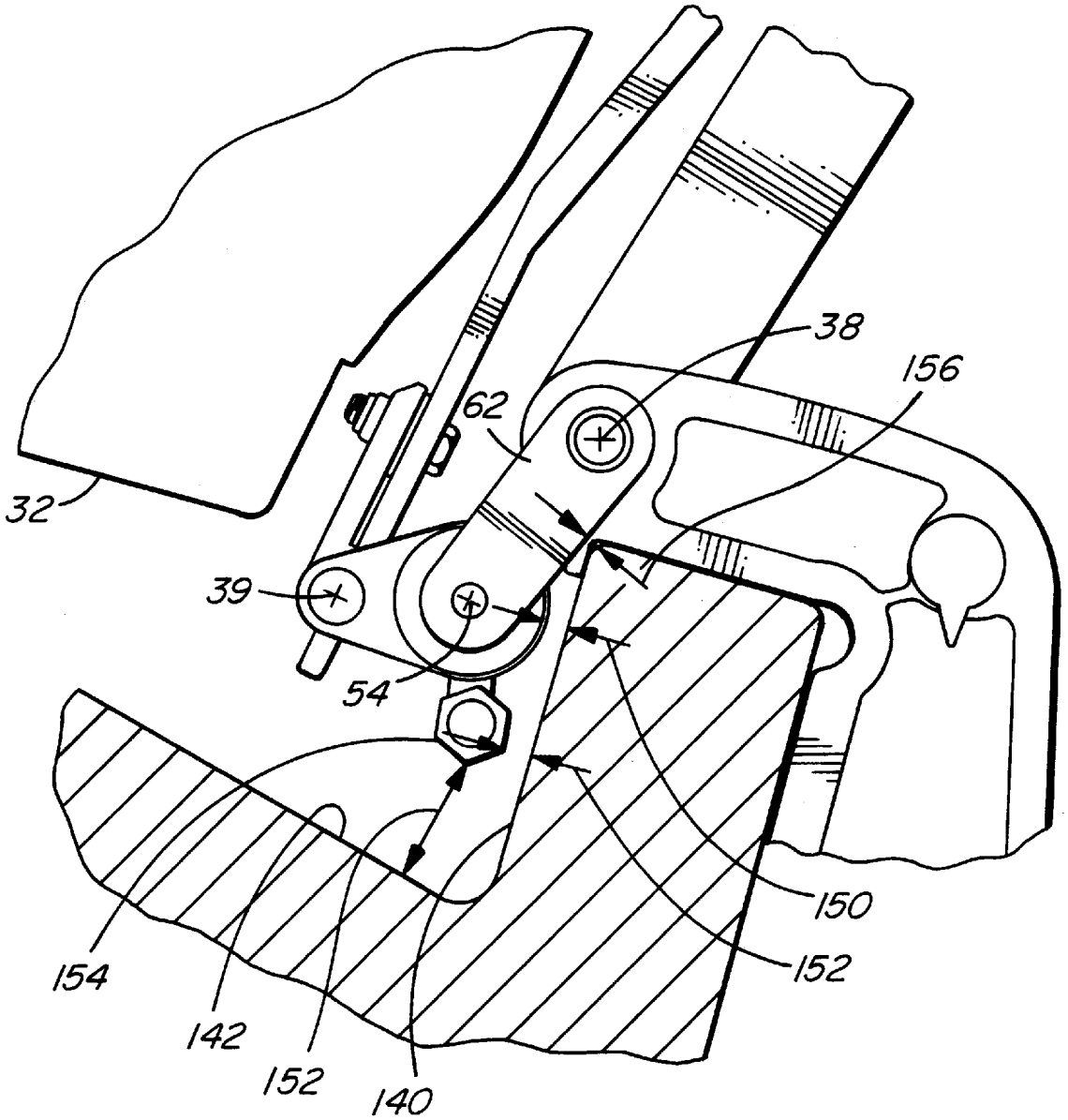
FIG. 4*b* is a view similar to FIG. 4*a* with the motor tilted to the trailering or fully tilted position.
Figure 4C:
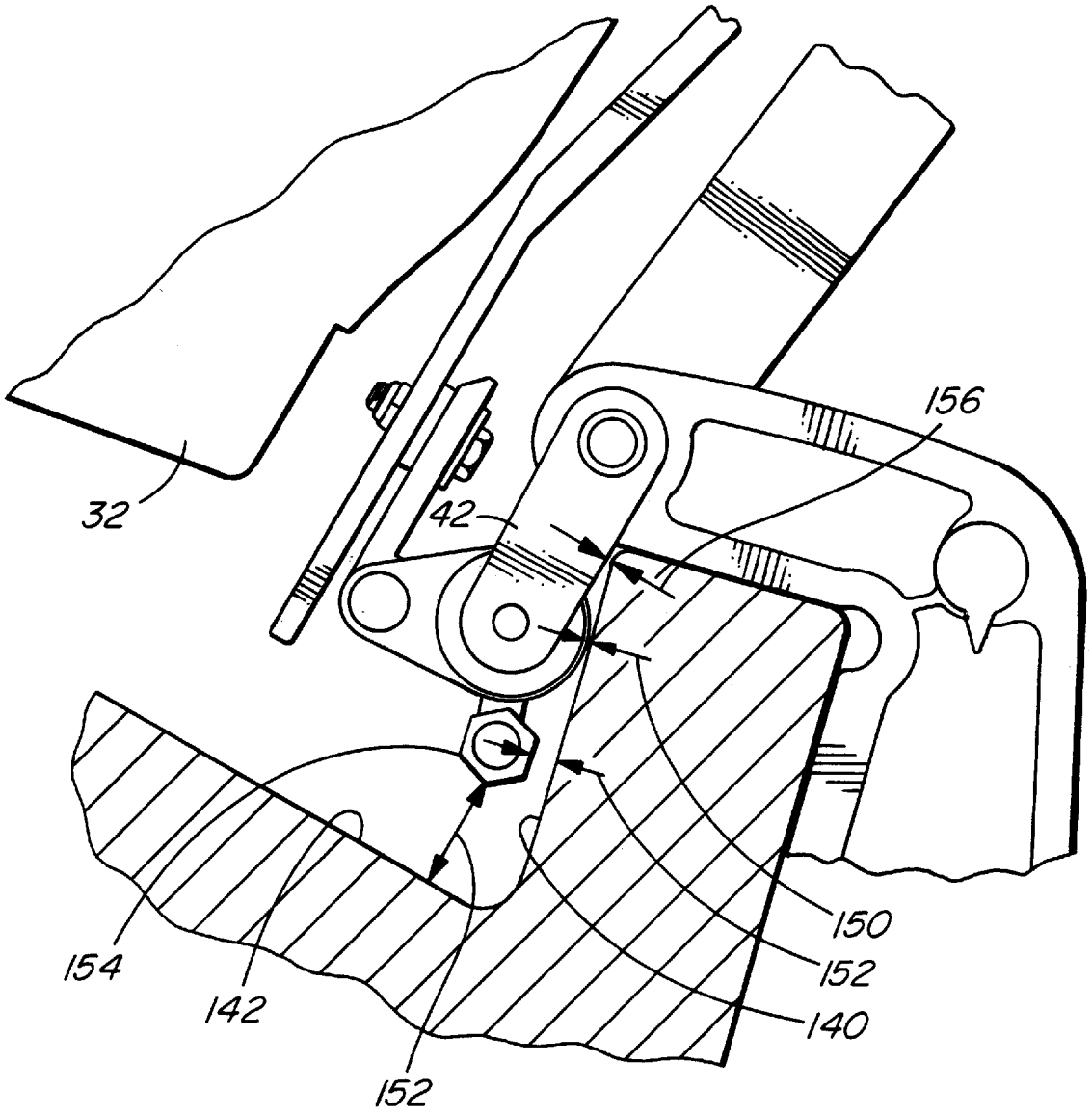
FIG. 4*c* is a view similar to FIG. 4*b*, with the pivot plate mounted under the tiller.

Midsection 34 of the motor has a tilt tube 36 and a support rod 37 passing through the tube which allow the motor to be tilted about a tilt axis 38 from the running position shown in FIG. 1 to the tilted positions as shown in FIGS. 4*b* and 4*c*.

A pair of support arms (or support brackets) 40 and 42 are mounted on opposite ends of the support rod. Each arm is somewhat z-shaped and has an aperture 44 receiving the rod. Each arm also has a second aperture 48 for connecting the arm to one end of piston rod 50 of the hydraulic cylinder 26. The piston rod is reciprocatingly mounted within the cylinder for relative movement along a piston rod axis 54. In fact the rod is axially stationary with respect to the boat while the cylinder reciprocates. The piston rod has a section 56 of reduced diameter received within the aperture 48 of each arm. The support arms allow arcuate movement of the piston rod 50 and the cylinder about the tilt axis 38, while maintaining the rod axis 54 parallel to the tilt axis 38.

The cylinder 26 has of pair of cylinder arms 60 and 62 which extend radially outwards from the piston rod axis 54. In this particular example, the arms are integral with end fittings 64 and 66 of the cylinder adjacent its ends 28 and 30 respectively. Each of the cylinder arms has an aperture 70 which receives a pivot pin 72 on a pivot plate 76. The pivot plate is pivotally mounted on the tiller arm 80 of the motor by means of tiller joint 82 which extends through inner apertures 86 of the tiller arm, shown in FIG. 4*a*. The tiller arm in this particular example also has an outer aperture 88, shown in FIG. 2. The inner aperture is closer to steering axis 90, shown in FIGS. 1 and 3*a*, than the outer aperture.

Figure 6:
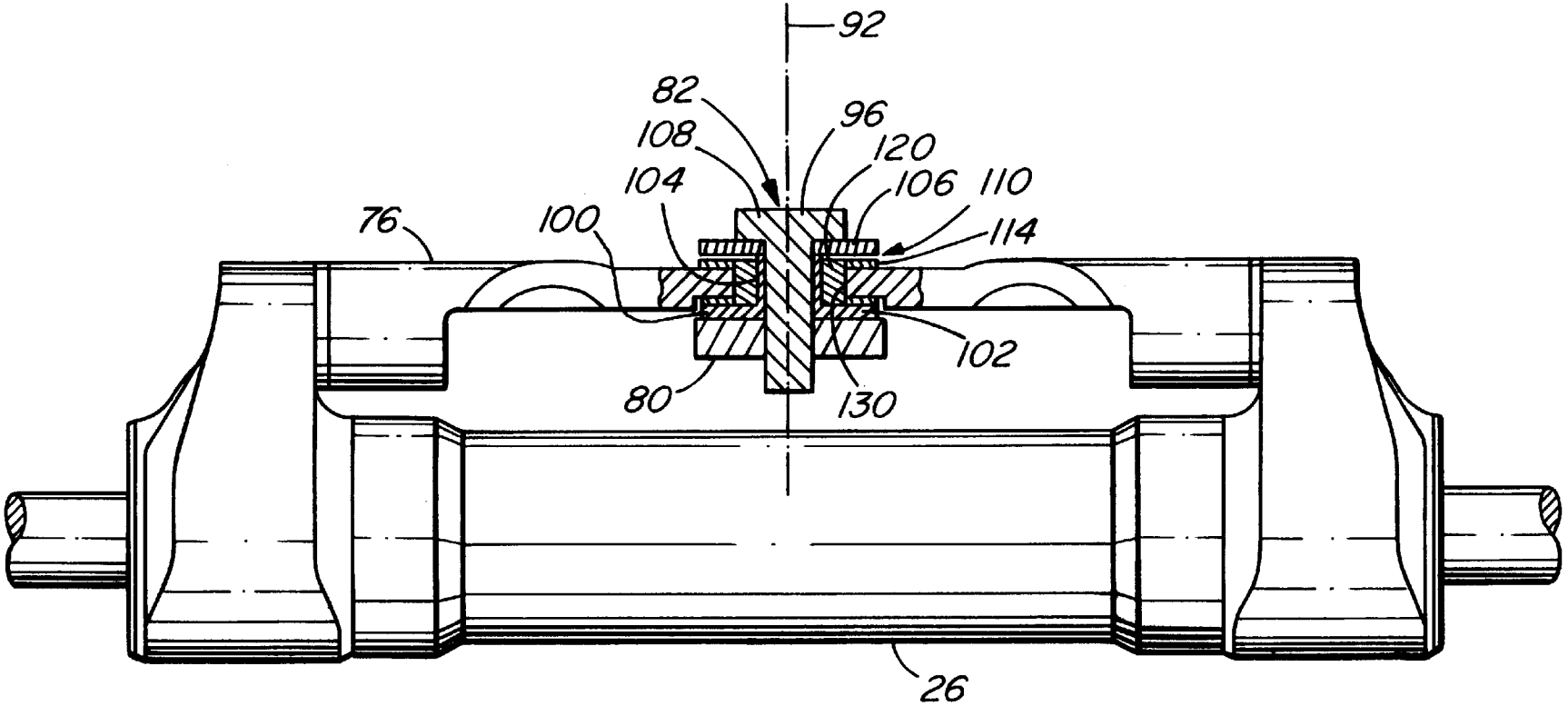
FIG. 6 is a fragmentary view showing portions of the steering system including the cylinder and the tiller joint in section.

Referring to FIG. 6, the tiller joint 82 pivotally mounts the pivot plate 76 on tiller arm 80 for pivoting about a first link axis 92 which is parallel to the steering axis 90. The joint in this example includes a bolt 96 which threadedly receives the tiller arm. A washer bush 100 is fitted over the bolt between the tiller arm and the pivot plate 76. The washer bush has a disk-shaped portion 102 connected to a sleeve-like portion 104 which contacts a washer 106 fitted between the head 107 of the bolt and the pivot plate. The length of the sleeve-like portion 104 provides a gap 110 between the washer 106 and tiller washer 114 resting against the top surface of the pivot plate.

The tiller washer 114 extends about the upper portion of resilient bushing 128 and aperture 130 of the tiller plate. The bushing should be stiff enough to transmit the steering forces, but permit limited tilting of the pivot plate relative to the tiller. In this example the bushing 120 is of acetal homopolymer although other polymers and other relatively stiff resilient and deformable materials could be substituted. This arrangement reduces torsional stresses on the tiller arm.

Figure 2:
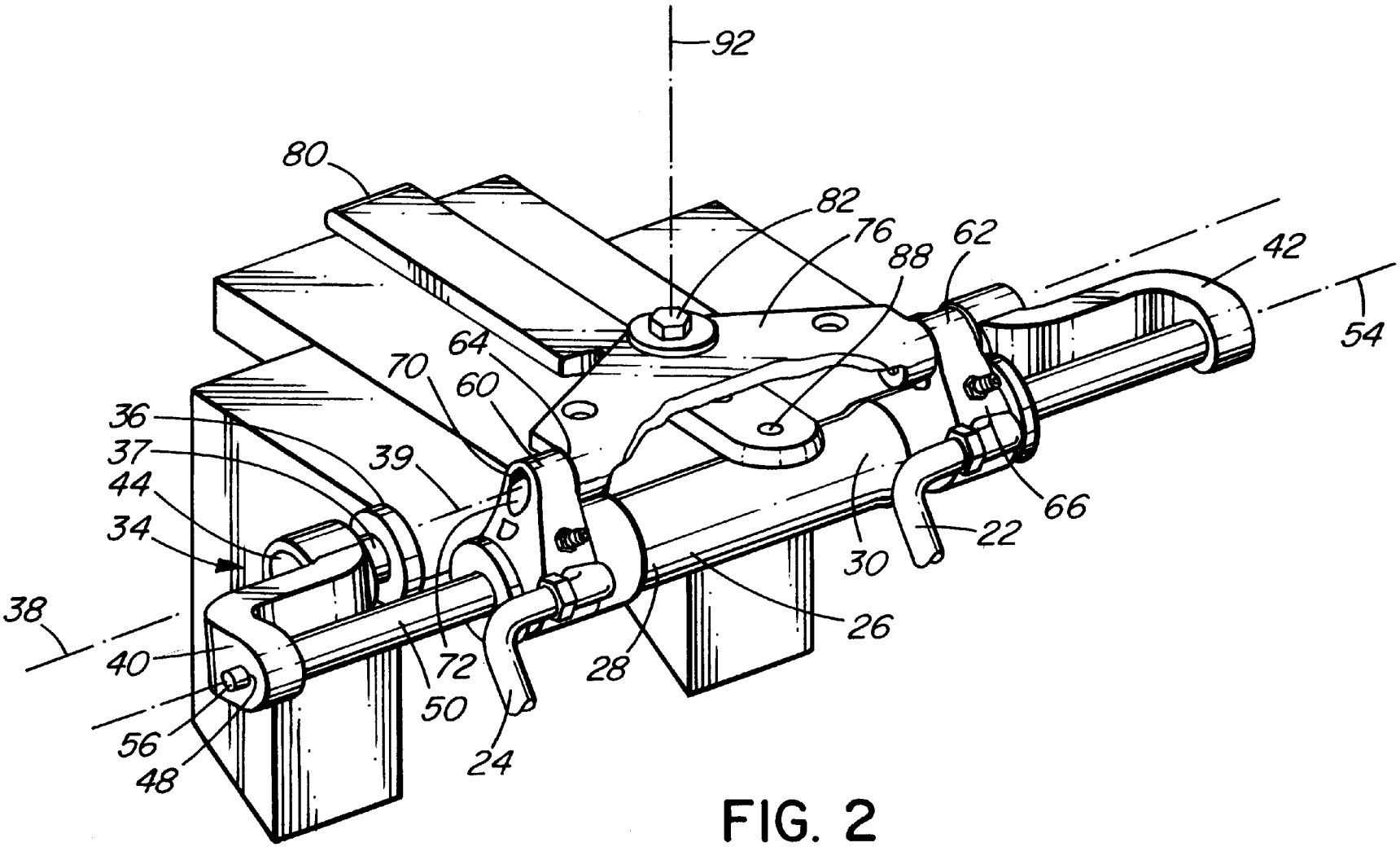
FIG. 2 is a top, front isometric view of a steering system according to an embodiment of the invention.
Figure 3A:
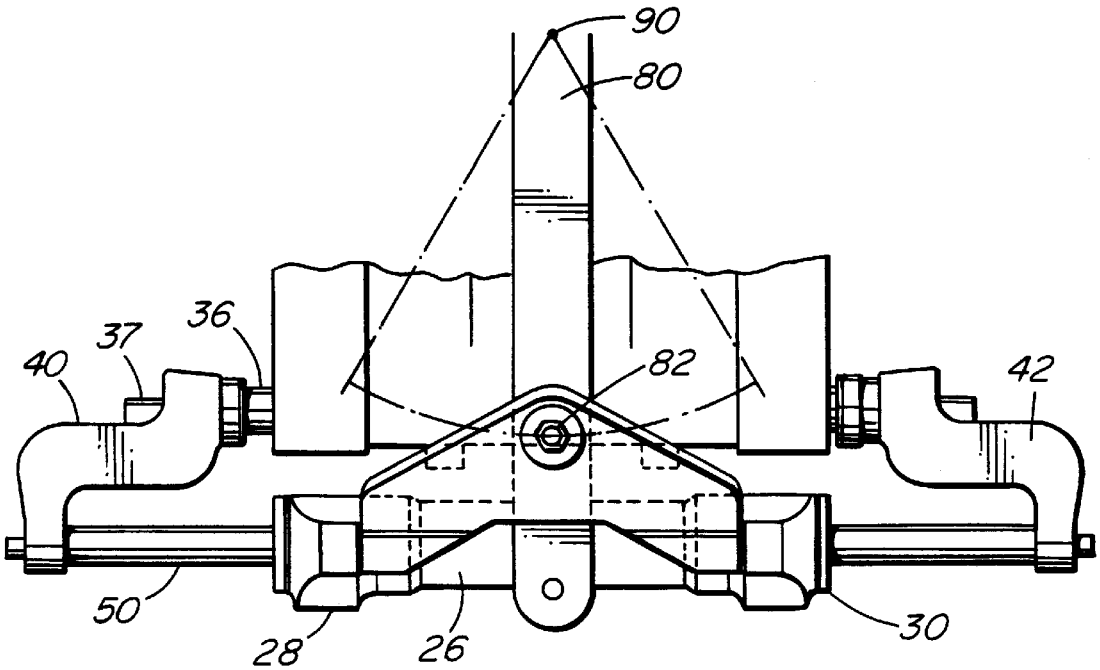
FIG. 3*a* is a top plan view thereof, shown at the center position.
Figure 3B:
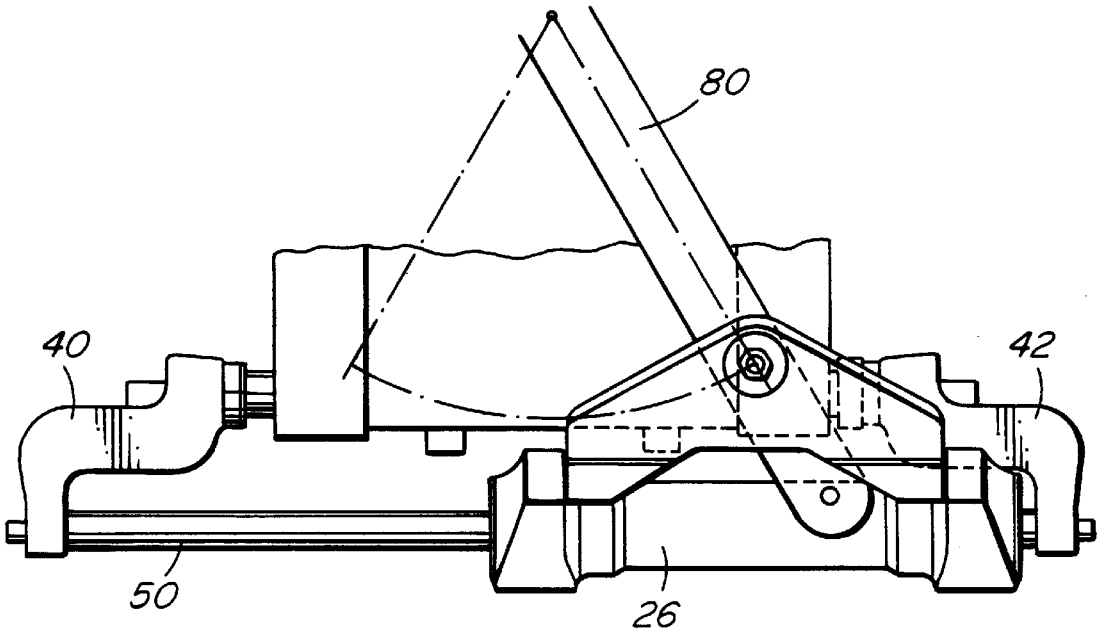
FIG. 3*b* is a view similar to FIG. 3*a* with the steering system shown at one hard over position.
Figure 5A:
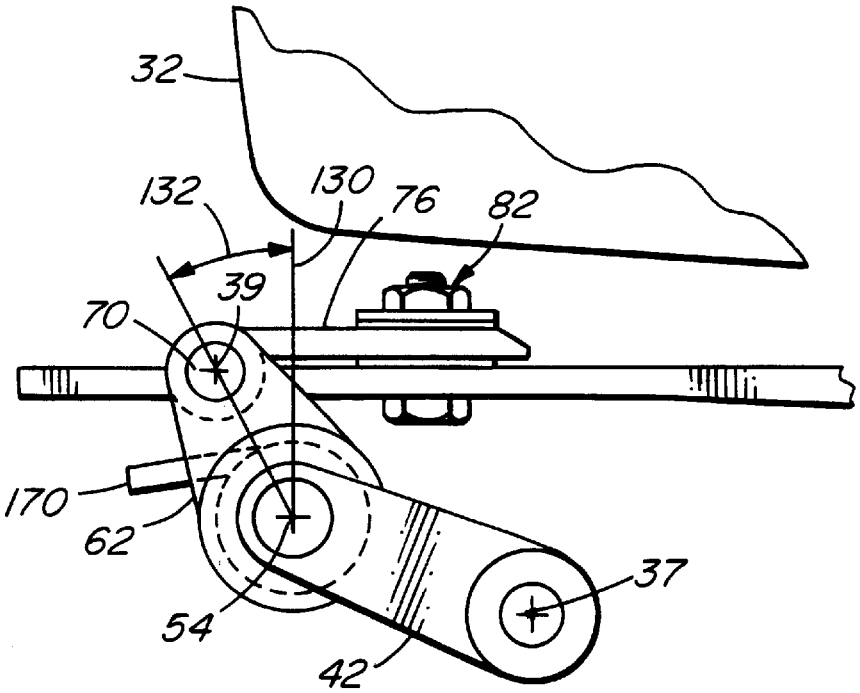
FIG. 5*a* is a side view of the steering system with the cylinder at the center position.

FIGS. 2 and 3*a* show the center position of the tiller arm which corresponds to steering the boat straight ahead. FIGS. 4*a* and 5*a* are side views of the components in the straight ahead position. When hydraulic fluid is pumped into the cylinder from pump 18 through either hydraulic line 22 or 24, the motor 32 is steered towards one of the hard over positions for maximum steering. For example, when hydraulic fluid is pumped through hydraulic line 22, it moves the cylinder 26 and the tiller arm 80 to the right from the plight of view of FIG. 3*a*. The maximum steering is achieved at the hard over position shown in FIG. 3*b*. This position is also shown from the side in FIG. 5*b*.

Figure 5B:
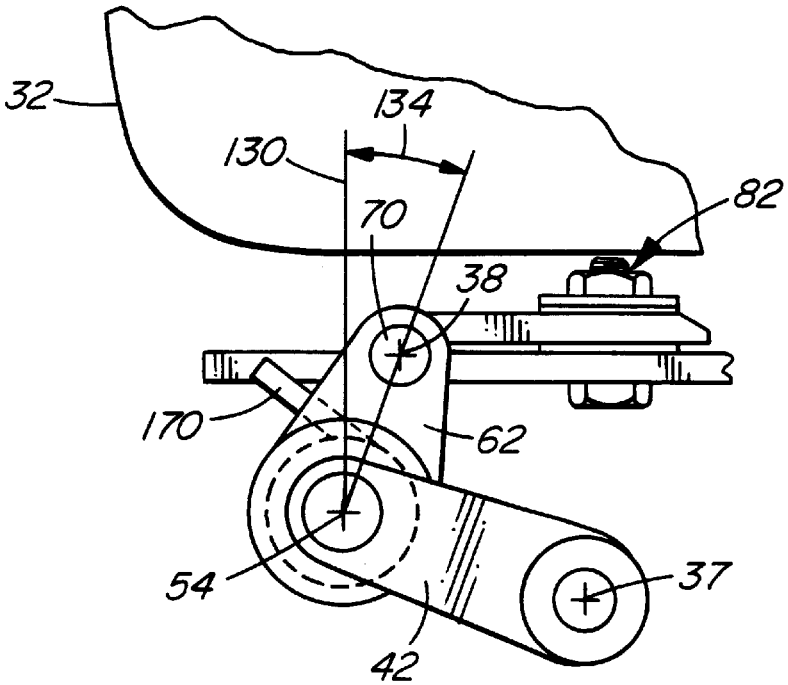
FIG. 5*b* is a view similar to FIG. 5*a* with the motor at one of the hard over positions.

By comparing FIG. 5*a* with FIG. 5*b*, it may be seen that the cylinder arm 62 (along with arm 60) not shown in these views, pivots about the piston rod axis 54 from a position angled forwardly from the motor 32 when the motor is at the center position shown in FIG. 5*a* to a position angled rearwardly towards the motor in the hard over position shown in FIG. 5*b*. The cylinder arms are similarly angled when the motor is in the opposite hard over position after the hydraulic fluid is pumped through hydraulic lines 24. When moving from the center position of FIG. 5*a* to the hard over position of FIG. 5*b*, the cylinder arm moves through rotational position where the second link axis 39 and the piston rod axis 54 are on the plane 130 which is parallel to the steering axis 90.

It has been found that this arrangement minimizes rotation of the support arms 40 and 42. In this particular example it may be seen that the cylinder arm is rotated away from the partially rotated position angular amounts, represented by angle 132 in FIG. 5*b* and angle 134 in FIG. 5*b*, when the steering assembly is at the center position and hard over positions. In this example angle 134 is about 30° and angle 132 is about 20° although this may vary in other examples. Because rotation of the support arms is minimized, it has been found that the boat can still be steered even when the support rod 37 is inhibited or prevented from rotating in the tilt tube 36. The normal play in the other components of the steering assembly allows the motor to steer even when this occurs. In fact the system may be designed with zero rotation of the support arms for certain outboard motors.

FIG. 4*a* shows the motor 32 in the normal running position and mounted on a transom 140 of the boat adjacent splash well 142. FIGS. 4*b* and 4*c* show the motor tilted with the pivot plate mounted above and below the tiller respectively. The relatively tight clearances required, and achieved by the steering assembly, are shown. Clearance 150 is the clearance between the motor and the transom. Clearance 152 is clearance between the transom and hose fittings 154. Clearance 156 is between the transom and support arms 60 and 62.

The steering cylinder has a bleed fitting 170 shown in FIGS. 5*a* and 5*b*. In the hard over positions of FIG. 5*b* the fitting is at the highest point on the cylinder and is tilted upwards to ease bleeding air from the cylinder.

It may be appreciated that many of the features described above are by way of example only and are not intended to limit the scope of the invention which is to be interpreted with reference to the following claims.

What is claimed is:

1. A hydraulic steering assembly for applying a force to a tiller arm of a marine, outboard propulsion unit and, accordingly, rotating the propulsion unit about a steering axis between a center position and hard over positions to each side of the center position, the propulsion unit being supported for arcuate movement about a tilt axis which is generally perpendicular to the steering axis, the steering assembly comprising:

a hydraulic steering cylinder;

an elongated piston rod reciprocatingly mounted within the cylinder for relative movement along a piston rod axis;

a pair of support arms which are pivotable about the tilt axis and are connected to the piston rod, allowing arcuate movement of the rod about the tilt axis, while maintaining the rod axis parallel to the tilt axis;

a member pivotally mounted on the tiller arm for pivoting about a first link axis which is parallel to the steering axis; and a cylinder arm, connected to the cylinder, which extends radially outwards from the piston rod axis, the cylinder arm being pivotally connected to the member for pivoting about a second link axis which is parallel to the piston rod axis, the cylinder arm moving through a rotational rotated position, where the second link axis and the rod axis are on a plane parallel to the steering axis when the propulsion unit rotates from the center position to either of said hard over positions.

2. A hydraulic steering assembly as claimed in claim 1, wherein the cylinder arm is angularly spaced-apart from said rotational position at the center position of the propulsion unit and at both said hard over positions.

3. A hydraulic steering assembly as claimed in claim 2, wherein the cylinder arm is rotated forwardly away from said partially rotated position generally 30° at the center position and rearwardly generally 20° at both said hard over positions.

4. A hydraulic steering assembly as claimed in claim 1, wherein the tiller arm has an inner aperture and an outer aperture, the inner aperture being closer to the steering axis than the outer aperture, the member being pivotally connected at the inner aperture.

5. A hydraulic steering cylinder as claimed in claim 1, wherein the member is a pivot plate, the assembly including one said cylinder arm at each and of the cylinder, both cylinder arms being pivotally connected to the plate for pivoting about the second link axis.

6. A hydraulic steering assembly as claimed in claim 1, wherein the member is pivotally mounted on the tiller arm by a pivotal connection which includes a resilient bushing.

7. A hydraulic steering assembly as claimed in claim 6, wherein the bushing is of a resilient polymer.

8. A hydraulic steering assembly as claimed in claim 1 wherein the cylinder has a bleed fitting which is at a highest point on the cylinder when the propulsion unit is at a running position and said hard over positions.

9. A hydraulic steering system as claimed in claim 8, wherein the fitting is angled upwardly at said hard over positions.

* * * * *